US007971326B2

(12) United States Patent
Apprederisse et al.

(10) Patent No.: US 7,971,326 B2
(45) Date of Patent: Jul. 5, 2011

(54) METHOD OF SETTING STONES IN A SUPPORT ELEMENT

(75) Inventors: Alan Apprederisse, Lausanne (CH); Johnny Buehler, Jongny (CH); Lionel A Marca, Grandson (CH)

(73) Assignee: Blancpain S.A., Paudex (CH)

( * ) Notice: Subject to any disclaimer, the term of this patent is extended or adjusted under 35 U.S.C. 154(b) by 1171 days.

(21) Appl. No.: 11/676,689

(22) Filed: Feb. 20, 2007

(65) Prior Publication Data

US 2007/0204463 A1 Sep. 6, 2007

(30) Foreign Application Priority Data

Feb. 28, 2006 (EP) ..... 06110493

(51) Int. Cl.
*B23P 5/00* (2006.01)
*A44C 17/02* (2006.01)
*A44C 17/04* (2006.01)

(52) U.S. Cl. ..... 29/10; 29/896.4; 63/27; 63/28

(58) Field of Classification Search ..... 29/10, 896, 29/896.3, 896.32, 896.33, 896.34, 896.4, 29/896.41, 896.411, 896.412; 63/27, 28
See application file for complete search history.

(56) References Cited

U.S. PATENT DOCUMENTS 3,365,877 A 1/1968 Altman
4,731,913 A * 3/1988 Plantureux et al. ..... 29/10
4,748,728 A * 6/1988 Magnien et al. ..... 29/10
4,761,865 A 8/1988 Magnien et al.
4,800,738 A 1/1989 Bunz
5,377,506 A * 1/1995 Tranzer ..... 63/28

FOREIGN PATENT DOCUMENTS

EP 1 048 241 A1 11/2000
FR 838.817 1/1939
FR 1.506.317 12/1967
GB 2 181 939 A 5/1987

OTHER PUBLICATIONS

European Search Report issued in corresponding application No. EP 06 11 0493, completed Jul. 17, 2006.

* cited by examiner

*Primary Examiner* — Sarang Afzali
(74) *Attorney, Agent, or Firm* — Griffin & Szipl, P.C.

(57) ABSTRACT

The invention concerns a method of setting a plurality of stones each having a culasse, a crown and a girdle in a metal support element. The method includes the steps of milling a groove on a first face of the support element; piercing from a second face of the support element, opposite to said first face, a plurality of holes each having a diameter substantially corresponding to the diameter of the girdle of the stone that it will receive, such that each hole opens into said groove and the bottom of each hole forms a support wall for the crown of the stone, forming grains in the second face of the support element in proximity to the support walls, setting the stones in place in the holes such that the crown of each stone abuts against the support wall of the hole thereof, and pushing the grains against the culasse of each stone in order to fix the stones in said support element.

13 Claims, 2 Drawing Sheets

METHOD OF SETTING STONES IN A SUPPORT ELEMENT

This application claims priority from European Patent Application No. 06110493.1, filed Feb. 28, 2006, the entire disclosure of which is incorporated herein by reference.

FIELD OF THE INVENTION

The present invention concerns a method of setting precious or semi-precious stones in a metal support element to produce pieces or jewellery or timepieces decorated with stones. The invention concerns more particularly a method of setting stones using grains in which the grains are not visible from the top of the decorated piece. The method of the invention is particularly suited to making dials set with a plurality of rows of stones, for timepieces.

BACKGROUND OF THE INVENTION

Various techniques for setting a plurality of precious stones on metal support elements are known within the field of jewellery and horology.

One conventional method consists in piercing holes, with flared edges forming a shoulder, in the surface of the support element, in arranging the stones in the holes so that the culasse of each stone rests on the shoulder of each hole, then immobilising the stones in the holes deforming the material of the support element to form a lip covering the contour of the stone. According to a variant of this method, the stones are held by grains manufactured integrally with the support element and deformed and pushed onto the stone to form small claws that hold the stones on the support element.

This setting method has the drawback of deforming the material of the support element on the side of the decorated face such that it is unsuitable if one wishes to give a refined and unified appearance to a surface decorated with precious stones. This method is particularly unsuitable if one wishes to make, on decorated surfaces, a plurality of rows of stones aligned in various directions and in which the means for holding the stones do not affect the appearance of the support element material.

It is an object of the present invention to overcome the drawbacks of the aforementioned prior art by providing a method of setting a plurality of stones on a support element in which the means for holding the stones on the support element are not visible from the decorated surface of the latter, without altering either the appearance of the set stones or the quality of the holding of the stones to the support element.

It is also an object of the present invention to provide a method of this type wherein the support element material on the side of the decorated face is not deformed in order to secure the stones.

It is also an object of the present invention to provide a method of this type wherein the element can be easily prepared in advance by automatic machining means.

SUMMARY OF THE INVENTION

The invention therefore concerns a method of setting a plurality of stones each having a culasse, a crown and a girdle in a metal support element including the steps consisting in:

milling at least one groove on a first face of the support element, called the decorated face;

piercing, from a second face of the support element, opposite to said first face, a plurality of holes the diameter of each substantially corresponds to the diameter of the girdle of the stone that these holes will receive, such that each hole opens into said at least one groove and that the bottom of each hole forms a support wall for the crown of the stone;

forming grains in the second face of the support element in proximity to the support walls;

setting the stones in place in the holes such that the crown of each stone abuts against the support wall of its hole, and pushing the grains against the culasse of each stone in order to fix the stones in said support element and to form a row of set stones.

Owing to this method, the material of the decorated face of the support element located in proximity to the stones is not deformed and keeps a clean, smooth appearance. Moreover, the presence of the groove emphasises the alignment of the stones thereby increasing the aesthetic appeal of the whole of the decorated part. It will also be noted that this method allows finishing operations to be omitted, such as trimming and polishing the support element in the area of the grains insofar as this are is no longer visible from the decorated face side of the support element.

It will also be noted that, when one wishes to align stones in a groove, the method of the invention provides a simple and economical solution for achieving this, particularly by implementing a minimum number of steps, and by simplifying those steps.

According to a preferred implementation of the invention, the width of the groove is substantially equal to or greater than the diameter of the holes at the place where the holes open into the groove and the holes are centred on the groove. Moreover, the holes are separated from each other by bridges of material to maintain sufficient rigidity for the support element, particularly when the support element includes a plurality of rows of set stones, for example to form a watch dial. The present invention also enables grooves to be made whose width varies and can also extend along varied lines of curvature which thus offers a large choice of geometries for arranging the stones on the decorated surface of the support element.

BRIEF DESCRIPTION OF THE DRAWINGS

Other features and advantages of the present invention will appear in the following description of a preferred embodiment, given by way of non-limiting example with reference to the annexed drawings, in which.

DETAILED DESCRIPTION OF THE ILLUSTRATIVE EMBODIMENTS

The setting method according to the invention will now be described within the scope of an application to making a timepiece dial having one face decorated with precious or semi-precious stones with reference to FIGS. 1 to 8.

Figure 1:
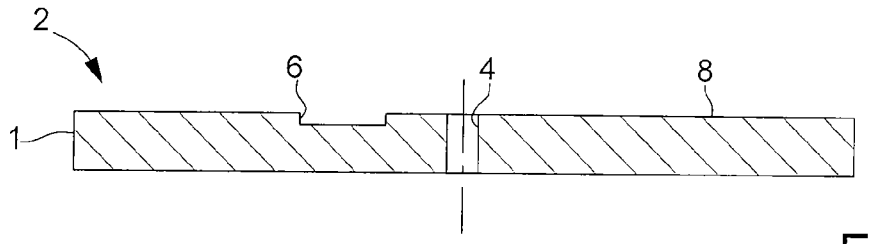
FIG. 1 is a cross-section of a support element after a groove has been milled in accordance with a first step of the method of the invention.

FIG. 1 shows a support element 1 taking the form of a metal plate for example of grey gold 150 several millimeters thick typically 1 mm and for making a dial 2 for a timepiece. Support element 1 includes, in a conventional manner, a hole 4 for the passage of the hands (not shown). Support element 1 further includes according to the process of the invention, at least one groove 6 made for example by milling, in the surface 8 which will form the decorated surface of dial 2. In the example illustrated, groove 6 is rectilinear and its width is constant, however, it goes without saying that, depending upon the desired appearance of the decorated surface, groove 6 can extend along a curved line of fixed or variable width, for example whose width flares from one end to the other.

Figure 2:
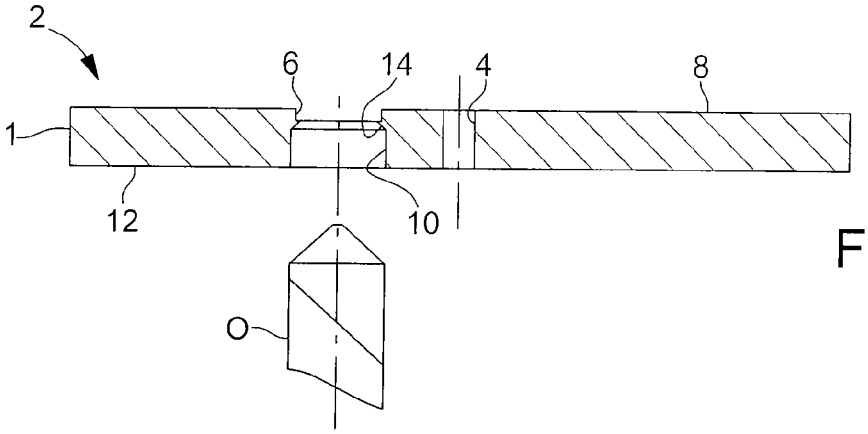
FIG. 2 is a cross-section of a support element after the step of piercing a hole for receiving a stone.

With reference to FIG. 2, the support element is seen after a second step of the setting method according to the invention, in which a plurality of perforations or holes 10 have been made from the opposite face 12 to the decorated face of support element 1 using a tool O. Perforations 10 are made such that they open into groove 6 and form a row of perforations along groove 6. The diameters of perforations 10 are slightly greater than the diameters of the girdle of the stones that they will receive. Depending upon the desired aesthetic effect, perforations 10 could of course each have different diameters. Perforations 10 according to the invention are made such that the bottom of each perforation forms a support wall 14 for the crown of the stone that they will receive. Typically, this support wall 14 is an inclined surface relative to the plane of support element 1, whose inclination substantially corresponds to the inclination of the crown of the stone that the hole will receive. In practice, a tool O whose tip has a corresponding apex angle will be chosen. If the thickness of support element 1 is small, perforations 10 are separated from each other by bridges of material 16 (FIG. 3*a*) to avoid adversely decreasing the rigidity of support element 1. It will also be noted that the width of groove 6 is substantially less than the diameter of holes 10 at the location where they open into the groove and holes 10 are centred on the axis A of groove 6.

Figure 3A:
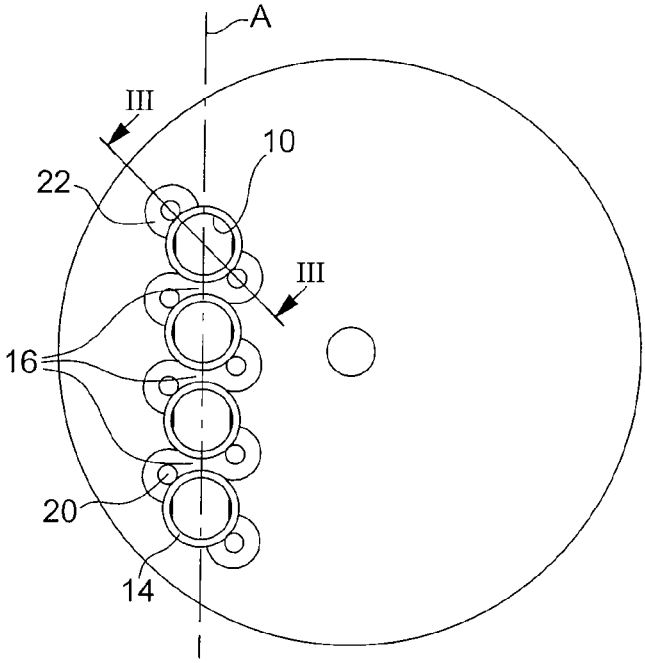
FIG. 3*a* is a bottom view of the support element after the milling steps for raising the grains.
Figure 3B:
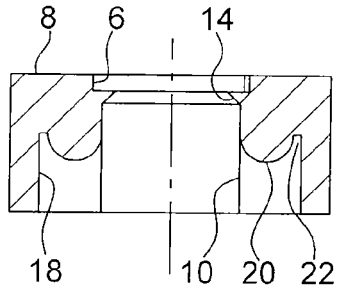
FIG. 3*b* is a partial cross-section along the line III-III of FIG. 3*a;*

FIGS. 3*a* and 3*b* illustrate the next step in the setting process according to the invention. This step consists in hollowing out hollows or countersinks 18 opening into perforations 10 in surface 12 of support element 1, using a cutting tool such as a mill, to raise or form grains 20 from bottom 22 of hollows 18 and if necessary, reworking grains 20 to facilitate the subsequent setting of the stones in the perforations. The grains will be used subsequently to hold the stones in the holes 10. In the example illustrated, there are two grains 20 per perforation 10 and they are arranged diametrically opposite relative to perforation 10. The number of grains can, of course, vary, particularly as a function of the size of the stones and the density of stones on support element 1. In this regard, it will be noted that, particularly if one wishes to set the stones in rows that are close together, the diameter according to which the two grains 20 are arranged will be inclined relative to the direction transverse to the direction of the groove at the location of perforations 10.

Figure 4A:
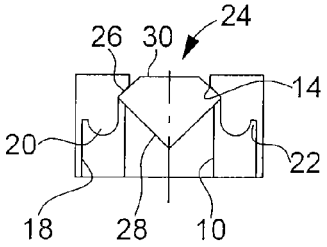
FIGS. 4*a* and 4*b* are partial cross-sections similar to FIG. 3*b* in which the stones are respectively mounted and set in the support element.
Figure 4B:
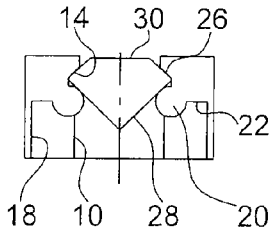
Figure 5:
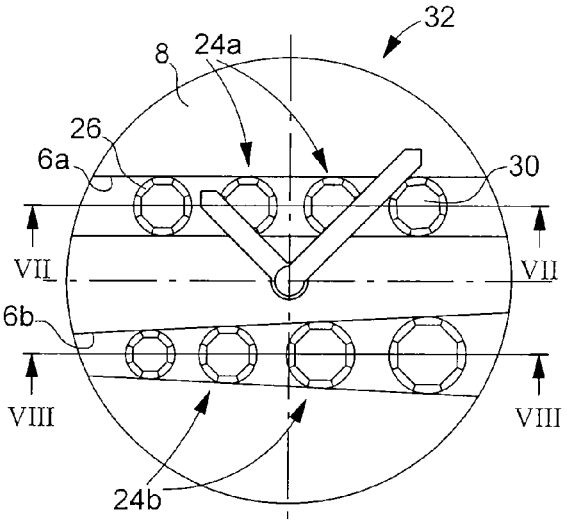
FIGS. 5 and 6 are respectively top and bottom views of a watch dial set with stones in accordance with the method of the invention.
Figure 6:
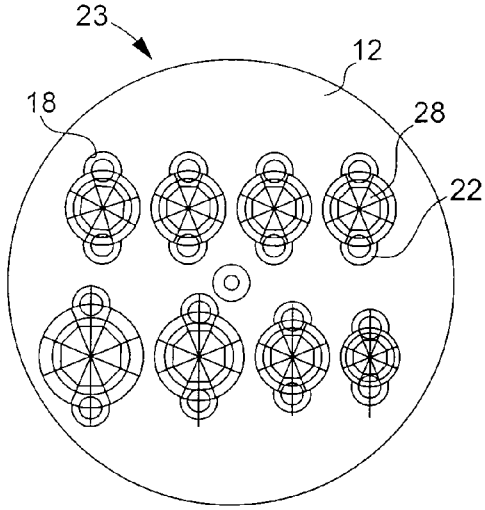
Figure 7:
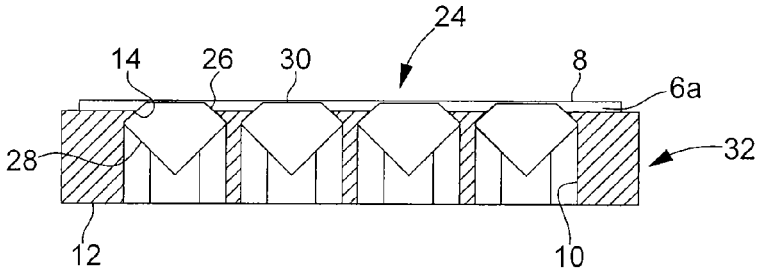
FIGS. 7 and 8 are cross-sections respectively along the lines VII-VII and VIII-VIII of FIG. 5.
Figure 8:
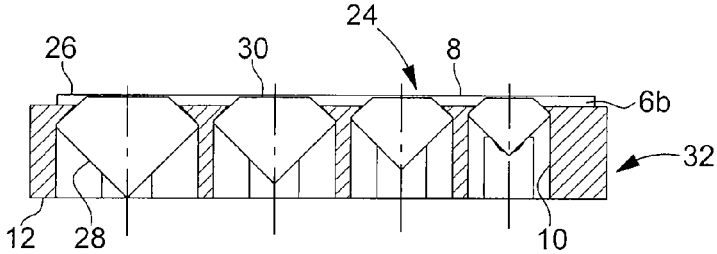

According to a variant (not shown) wherein perforations 10 are spaced out in relation to each other to form bridges of material between them, grains 20 can be arranged in these bridges of material 18 and grains 20 can be configured so that one grain fixed two juxtaposed stones. FIG. 4*a* shows support element 1 in which stones 24 have been set in place in holes 10 but prior to the definitive fixing of the stones in support element 1. In order to do this, and since the diameter of each perforation corresponds to the diameter of the girdle of the stone that it will receive, the stones need only be pushed into the bottom of the perforation from face 12 until crowns 26 of each stone 24 abut against support wall 14. Once they are set in place, stones 24 are then immobilised in their perforation 10 during a "boulage" step wherein grains 20 are pushed back against the culasse 28 of each stone as is shown in FIG. 4*b*. This operation is achieved using a conventional tool called a beader. Once set, table 30 and a portion of crown 26 of each stone are then visible on face 8 of dial 2, the height to which the stones extend beyond face 8 could easily be adjusted by acting on the depth of the grooves and/or the perforations.

The method of the invention thus provides objects decorated with set stones wherein the means for holding the stones on the object are not on the side of the decorated face.

By way of example, FIGS. 5 to 8 show a dial 32 for a timepiece set with stones in accordance with the method of the invention. Dial 32 includes two rows of set stones 24*a* namely a first row formed of a plurality of stones of substantially the same size arranged along a rectilinear groove 6*a* of constant width and a second row formed of a plurality of stones 24*b* of increasing size arranged along a groove 6*b*, the width of which increases proportionally to that of the stones. In these Figures, the elements identical to those described with reference to the preceding Figures are designated by the same reference numerals.

It will be understood that various alterations and/or improvements evident to those skilled in the art can be made to the embodiment described in the present description without departing from the scope of the present invention defined by the annexed claims. One could, in particular, use the method of the invention for decorating bracelet links, watch bezels and all kinds of stones, or other set pieces.

What is claimed is:

1. A method of setting a plurality of stones each having a culasse, a crown and a girdle in a metal support element including the steps of:

milling a groove on a first face of the support element;

piercing from a second face of the support element, opposite to said first face, a plurality of holes each having a diameter substantially corresponding to the diameter of the girdle of the stone that it will receive, such that each hole opens into said groove and the bottom of each hole forms a support wall for the crown of the stone;

forming grains in the second face of the support element in proximity to the support walls;

setting the stones in place in the holes such that the crown of each stone abuts against the support wall of the hole thereof; and pushing the grains against the culasse of each stone in order to fix the stones in said support element.

2. The setting method according to claim 1, wherein at least two grains are associated with each hole.

3. The setting method according to claim 2, wherein the diameter along which the two grains are arranged is inclined relative to the transverse direction to the direction of the groove.

4. The setting method according to claim 2, wherein the holes are separated from each other by bridges of material, wherein the grains are arranged in the bridges of material and wherein one grain fixes two juxtaposed stones.

5. The setting method according to claim 1, wherein the width of the groove is substantially equal to or greater than the diameter of the holes at the place where the holes open into the groove.

6. The setting method according to claim 5, wherein the holes are centred on the axis of the groove.

7. The setting method according to claim 1, wherein the width of the groove is variable from one end of the groove to the other end of the groove.

8. The setting method according to claim 7, wherein the holes are separated from each other by bridges of material, wherein the grains are arranged in the bridges of material and wherein one grain fixes two juxtaposed stones.

9. The setting method according to claim 1, wherein the holes are centred on the axis of the groove.

10. The setting method according to claim 1, wherein the holes are separated from each other by bridges of material.

11. The setting method according to claim 1, wherein the groove extends along a curved line.

12. The setting method according to claim 1, wherein the grains are made in housing formed by countersinks opening laterally into the holes, the grains being arranged in the bottom of said countersinks.

13. The method according to claim 1, wherein the support element is formed of a plate forming a timepiece dial.

* * * * *